US007788772B2

(12) United States Patent
Dandurand

(10) Patent No.: US 7,788,772 B2
(45) Date of Patent: Sep. 7, 2010

(54) SHOULDER STRAP HOLDER

(75) Inventor: Louise Dandurand, P.O. Box 6095, Succ, Rock-Forest, Sherbrooke, Quebec (CA) J1N 3C8

(73) Assignee: Louise Dandurand, Sherbrooke, Quebec (CA)

( * ) Notice: Subject to any disclaimer, the term of this patent is extended or adjusted under 35 U.S.C. 154(b) by 0 days.

(21) Appl. No.: 11/983,337

(22) Filed: Nov. 9, 2007

(65) Prior Publication Data

US 2008/0235917 A1 Oct. 2, 2008

(30) Foreign Application Priority Data

Mar. 26, 2007 (CA) ..... 2583925

(51) Int. Cl.
*A44B 1/30* (2006.01)

(52) U.S. Cl. ..... 24/105; 24/90.1

(58) Field of Classification Search ..... 224/264; 2/460; 24/105, 104, 106–108, 114.7, 695
See application file for complete search history.

(56) References Cited

U.S. PATENT DOCUMENTS 127,183 A * 5/1872 Monks ..... 24/105
373,250 A * 11/1887 Simon ..... 24/105
625,532 A * 5/1899 Bachman ..... 24/105
1,400,420 A * 12/1921 Colley ..... 24/105
2,162,275 A * 6/1939 Stanchfield ..... 24/108
3,135,032 A * 6/1964 Althens ..... 24/114.7
4,959,890 A * 10/1990 Pazurek ..... 24/113 MP

FOREIGN PATENT DOCUMENTS

JP 2000154412 A * 6/2000

* cited by examiner

*Primary Examiner*—Robert J Sandy

(57) ABSTRACT

A shoulder strap holder for a garment that can be worn on a shoulder of a jacket, a coat or any clothing which is aesthetically pleasing and can be worn as is. The shoulder strap holder comprising two monocoque parts; a top plate with a grooved design, a cylindrical portion with an interior cavity having a screw thread formed therein and terminating at one end thereof in a flange comprising a plurality of apertures; a bottom plate comprising a pin screw extending outwardly therefrom and a plurality of apertures representing the sewing holes, the pin screw being screwed in the cylindrical portion through an eyelet fixed on the shoulder portion of a garment leaving an holding space to hold on any strap, the eyelet catching and protecting the fabric or material thus forming a shoulder strap holder for a garment.

4 Claims, 1 Drawing Sheet

SHOULDER STRAP HOLDER

FIELD OF THE INVENTION

The invention relates to a shoulder strap holder for a garment.

BACKGROUND OF THE INVENTION

This shoulder strap holder for a garment particularly satisfies a need, exigency and curiosity in people's life for newness and something unusual. Buttons or broochs on a garment such as shirts, blouses, dresses and jackets together, snap fasteners are commonly employed. In particular, the present invention is a new easy to use concept by simply screwing on the two pieces together through an eyelet fixed on the shoulder portion of a garment. It is also aesthetically pleasing and can be worn as is.

SUMMARY OF THE INVENTION

This new shoulder strap holder invention is compact and can be secured by simply screwing in the two monocoque parts together to the shoulder of a garment through an eyelet. According to one aspect of the present invention, the improvement comprising a shoulder strap holder having two monocoque parts, a bottom plate with a pin screw, and a top plate with a cylindrical portion with an interior cavity having a screw thread formed releasably retaining the pin screw. Once the pin screw has been passed through the eyelet placed on the shoulder of a garment and has been screwed in the cylindrical portion, it catches the material or fabric leaving an holding space to hold on any strap. According to one aspect of the present invention, the shoulder strap holder is to improve the look of the shoulder of a garment.

DETAILED DESCRIPTION OF THE DRAWINGS

Figure 1:
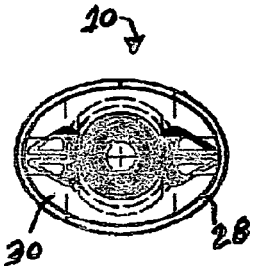
FIG. 1, is a top view of a top plate having a grooved surface according to the present invention.
Figure 2:
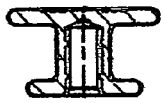
FIG. 2, is a cross sectional view thereof.
Figure 3:
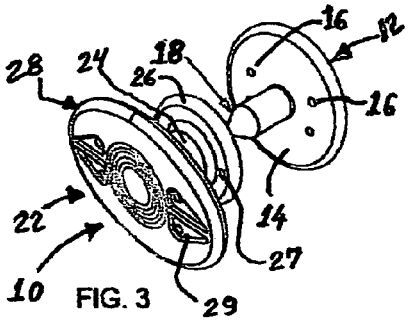
FIG. 3, is an exploded view of the present invention.
Figure 4:
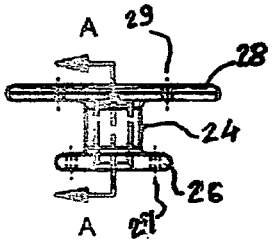
FIG. 4, is a side elevational view thereof.
Figure 5:
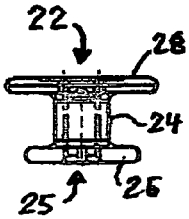
FIG. 5, is a front elevational view thereof.
Figure 8:
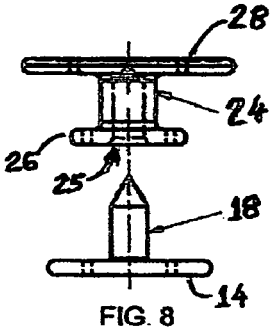
FIG. 8, is an exploded view of the two monocoque members.
Figure 6:
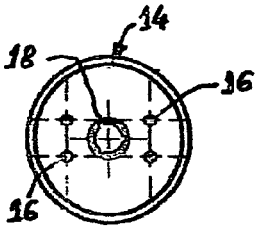
FIG. 6, is a top view of the bottom plate member.
Figure 7:
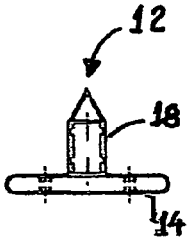
FIG. 7, is a side elevational view of the bottom plate.
Figure 9:
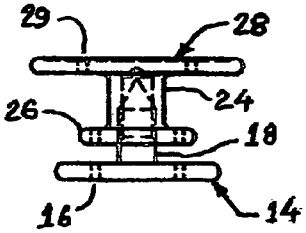
FIG. 9, is a side elevational view illustrating assembly of the two monocoque parts.
Figure 11:
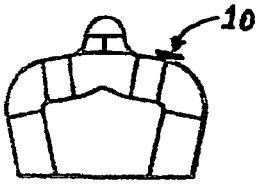
FIG. 11, is an elevational view of the shoulder strap holder attached to a shoulder portion of a garment through the eyelet.
Figure 10:
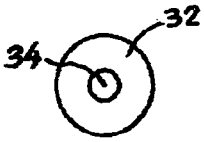
FIG. 10, is a top plan view of an optional protective eyelet.

Referring to the drawings in greater details and by reference characters thereto, there is illustrated in the drawings an embodiment of the present invention. The shoulder strap holder is indicated generally by reference numeral 10 and comprises a monocoque bottom plate 12 and a monocoque top plate 22. Bottom plate 12 includes a bottom plate 14 which has a plurality of apertures 16 formed therein. In the illustrated embodiment, for such apertures 16 are illustrated; more may be provided if desired. A pin screw 18 extends outwardly from bottom plate 14, pin screw 18 may, if desired, be screw threaded or take another form so as to provide a releasable retaining movement as will be discussed in greater detail herein below. Monocoque top plate 22, includes a cylindrical portion 24, cylindrical portion 24 has an interior cavity 25 and terminates, at one end thereof, in a radially flange 26. At the other end of the cylindrical portion 24, there is provided a top plate 28, which may be of a various configuration although a generally configuration such as may be seen in FIG. 1 if preferred. It will be noted that apertures 29 are for the purposes of illustration only, apertures 27 and 16 are provided to permit sewing of the monocoque top and bottom plate to a shoulder of a garment, they are provided in flange 26 and bottom plate 12 respectively. Top plate 22 has a surface grooved desing 30. In one embodiment, cylindrical portion 24 base an interior cavity having a screw thread formed on the inside thereof.

In one embodiment of the present invention, there is provided an optional eyelet element 32 having an aperture 34 located centrally thereof, this eyelet may be of a flexible material for protecting the fabric of the garment. Depending on the manufacturing process, these shown oval and round drawings can be made in many other shapes, irregular shapes, forms, sizes and thickness. Also this invention can be made of any material such as: plastic, thermoplastic, wood, metal or other like, gold, silver, copper, enamel, nacre, glass, ivory, aluminum, ceramic, brass, celluloid, and of any other elements not described herewith if desired. It will be understood that the above described embodiment is for purposes of illustration only and that changes and modifications may be made thereof whitout departing from the spirit and scope of the present invention.

What is claimed is:

1. A shoulder Strap holder for a garment, comprising:

a shoulder strap holder for a garment, said garment having an eyelet fixed on the shoulder portion through the fabric or material, said shoulder strap holder having two monocoque parts;

a monocoque bottom plate having a plurality of apertures to permit securement of said monocoque bottom plate to a shoulder of a garment, said monocoque bottom plate having a pin screw extending outwardly therefrom; and a monocoque top plate having a surface and a peripheral edge, said surface having a grooved design, said monocoque top plate having a cylindrical portion extending outwardly therefrom and spaced inwardly from the said peripheral edge, said cylindrical portion having an interior cavity, said interior cavity having a screw thread formed therein, said cylindrical portion terminates in a flange at a distal end, said flange having plurality of apertures to permit securement of said monocoque top plate to a shoulder of a garment, said interior cavity of said cylindrical portion being sized to receive said pin screw, said cylindrical portion releasably retaining said pin screw by cooperation of said screw thread with said pin screw whereby a gap is formed between the monocoque top plate and the flange by the cylindrical portion.

2. The shoulder strap holder for a garment as claimed in claim 1, wherein said surface of the monocoque top plate having a plurality of apertures.

3. The shoulder strap holder for a garment as claimed in claim 1, wherein said monocoque bottom plate being secured to said garment by threads extending through said apertures of said monocoque bottom plate.

4. The shoulder strap holder for a garment as claimed in claim 1, wherein said pin screw being, screwed in said cylindrical portion through said eyelet fixed on the shoulder portion of a garment leaving an holding space to hold on any strap said eyelet catching and protecting the fabric or material thus forming said shoulder strap holder for a garment.

* * * * *